US008511554B2

(12) United States Patent
Grobbelaar

(10) Patent No.: US 8,511,554 B2
(45) Date of Patent: Aug. 20, 2013

(54) DISPLAY DEVICE AND DATA DISPLAY SYSTEM

(75) Inventor: Warren Grobbelaar, Johannesburg (ZA)

(73) Assignee: Integrated Pricing Technologies (Pty) Ltd., Johannesburg (ZA)

( * ) Notice: Subject to any disclaimer, the term of this patent is extended or adjusted under 35 U.S.C. 154(b) by 405 days.

(21) Appl. No.: 12/676,823

(22) PCT Filed: Sep. 12, 2008

(86) PCT No.: PCT/ZA2008/000083

§ 371 (c)(1),
(2), (4) Date: Mar. 5, 2010

(87) PCT Pub. No.: WO2009/036474

PCT Pub. Date: Mar. 19, 2009

(65) Prior Publication Data

US 2010/0252517 A1 Oct. 7, 2010

(51) Int. Cl.
*G07B 15/02* (2011.01)

(52) U.S. Cl.
USPC ..... 235/384; 235/383

(58) Field of Classification Search
USPC ..... 235/383, 384, 385
See application file for complete search history.

(56) References Cited

U.S. PATENT DOCUMENTS

| | | | | |
|---|---|---|---|---|
| 3,492,615 | A | 1/1970 | Watkins | |
| 3,594,785 | A | 7/1971 | Orenbuch | |
| 3,731,066 | A | 5/1973 | Menke | |
| 6,705,407 | B2 * | 3/2004 | Heinonen et al. | 173/105 |
| 7,153,209 | B2 * | 12/2006 | Rothkranz et al. | 463/22 |
| 7,241,220 | B2 * | 7/2007 | Rothkranz et al. | 463/20 |

FOREIGN PATENT DOCUMENTS

WO 9209061 5/1992

* cited by examiner

*Primary Examiner* — Daniel St. Cyr
(74) *Attorney, Agent, or Firm* — Fitch, Even, Tabin & Flannery, LLP

(57) ABSTRACT

A display device which includes a housing, a plurality of separately movable indicators in the housing, each indicator including a plurality of symbols, an electrically operable actuator and a controller for controlling operation of the actuator whereby each indicator is independently movable to a selected position to display a selected symbol.

20 Claims, 11 Drawing Sheets

10

BATTERY
MEMORY
42
44
50
INPUT
OUTPUT
PROCESSOR
MOTOR
18
46
40
LED
DISPLAY
56
120
CLOCK
48
16
IR TX
34
14
20
PROCESSOR
BATTERY
PROCESSOR
IR
DATA
30
36
24
22
MEMORY
32
ID 1
ID 2
PRICE
EFFECTIVE DATE
DISPLAY
MEMORY DATA
100
102
104
106
108
110

DISPLAY DEVICE AND DATA DISPLAY SYSTEM

CROSS-REFERENCE TO RELATED APPLICATIONS

This is a U.S. National Phase of International Application PCT/ZA2008/000083, filed Sep. 12, 2008, and claims the benefit of priority under 35 U.S.C. §119 based on South African Application No. 2007/08399, filed Sep. 15, 2007, the entire disclosures of which applications are hereby incorporated herein by reference.

BACKGROUND OF THE INVENTION

This invention relates generally to the display of data. The invention finds particular application for the display of data such as pricing information in a store or similar outlet but it is to be understood that this application is given by way of example only and is non-limiting.

In general terms two pricing methods are employed by retail outlets. Firstly a price label is physically adhered to an item. Secondly a price indicator is placed on an edge of a shelf on which items which are being sold are displayed.

In a large store the effort require to label individual items or to keep pricing information up to date and accurate, where there are a large number of items offered for sale, can be substantial. The problem is compounded during promotion events, when new stock comes in, and the like.

A system which has been proposed, to address the aforementioned requirements, makes use of electronic price tags each of which includes an LCD display. Data to a tag is transmitted, typically using wireless means, and the display is energised with appropriate pricing information. This type of system is feasible but is complicated and requires substantial capital investment. In addition each display requires an energy source, e.g. a battery, to keep it actuated.

The invention is concerned with an alternative device which does not require a continuous supply of electrical energy to display data, and which lends itself for an incorporation into a comprehensive display system.

SUMMARY OF INVENTION

The invention provides a display device which includes a housing, a plurality of separately movable indicators in the housing, an electrically operable actuator and a controller for controlling operation of the actuator whereby each indicator is independently movable to a selected position.

The housing may have a window and the indicators may be mounted so that at least portions of the indicators are visible through the window.

Each indicator may be movable in any appropriate way e.g. rotational or linearly. This movement may be uni-directional. Each indicator may be of any suitable shape and, depending on the application, may be circular, in the form of a strip of material or an endless loop.

Each indicator may include a plurality of symbols which may be alphanumeric. In a variation of the invention a plurality of the indicators are manipulated to represent a chosen symbol.

In one form of the invention the indicators are mounted for rotation about respective axes which are positioned so that they lie regularly spaced from each other on a straight line.

Each indicator may include a plurality of formations for direct or indirect engagement with the actuator. The formations may be of any appropriate type and may for example be holes, serrations, tooth-like formations or the like.

The actuator may be movable in any appropriate way and for example may be linearly movable. The actuator may be movable in a straight line to and fro i.e. with a reciprocating action.

In another form of the invention each indicator is movable along a defined path, in a controlled way, to present a chosen symbol for viewing, through a window.

Indicators selected from a designated plurality of indicators may be moved to make up a chosen symbol and indicators which are not selected may be blocked from view.

The invention also provides a data display system which includes a data store, apparatus to transfer data from the data store to a display location which is selected from a plurality of display locations and, at each display location, a respective actuating mechanism which, in response to data transferred to the respective display location, causes movement of at least one indicator to display information from the data source.

Data may be transferred from each display location, when required, to the data store.

The transfer of data may be effected in any appropriate way and may be done using wireless techniques. In one example of the invention a portable apparatus is employed which is loaded with data from the data store and then transported to the vicinity of a display location whereupon data is transferred from the apparatus to the display location.

BRIEF DESCRIPTION OF THE DRAWINGS

The invention is further described by way of examples with reference to the accompanying drawings in which.

DESCRIPTION OF PREFERRED EMBODIMENTS

Figure 1:
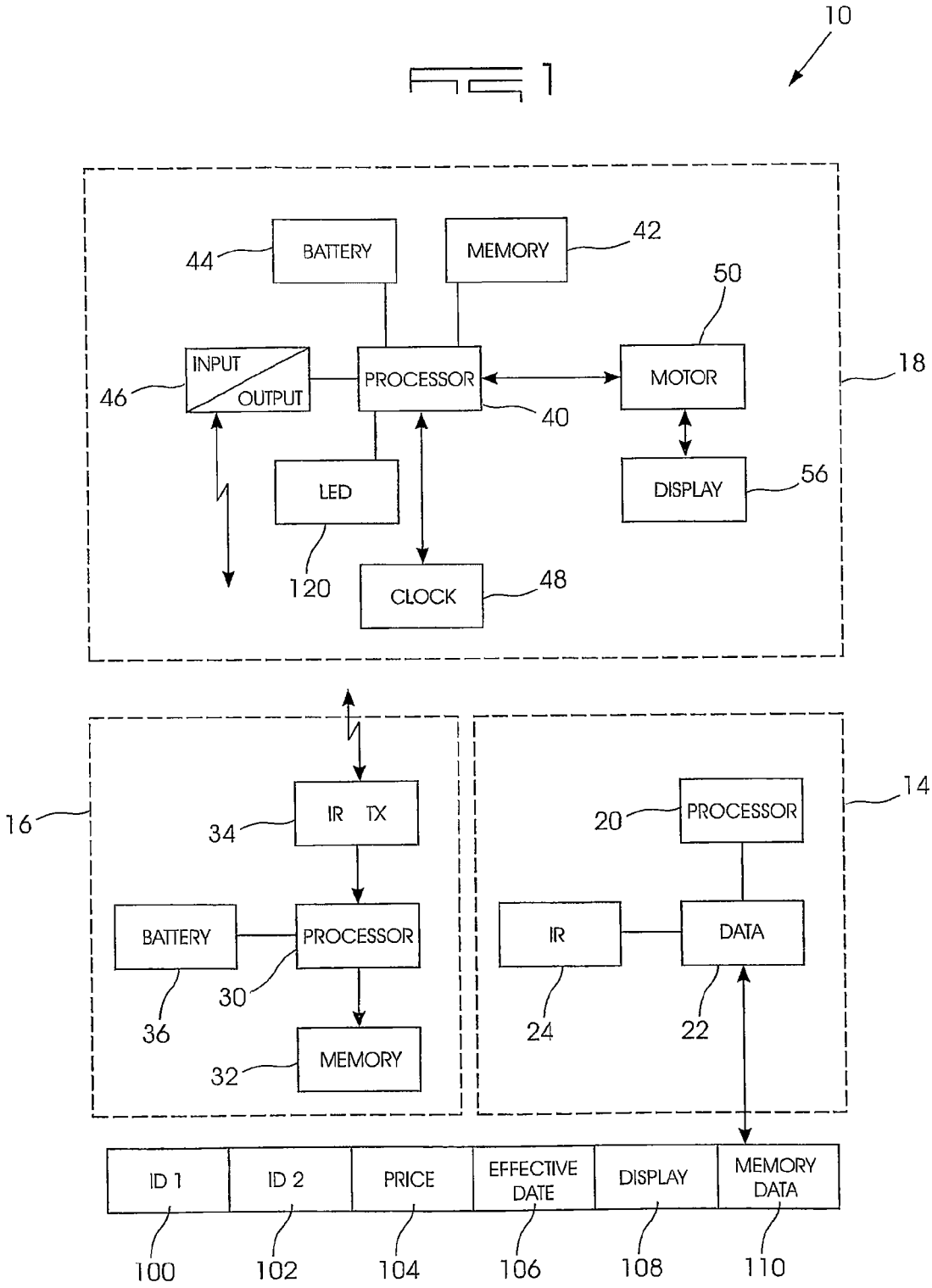
FIG. 1 is a block diagram representation of part of an electromechanical data display system.

FIG. 1 is a block diagram representation of a data display system 10 which includes a central control unit 14, a number of updaters 16 (only one of which is shown), and a number of display devices 18 (only one of which is shown).

The control unit 14 includes a processor 20, a memory 22 and one or more infrared transmitters/receivers 24.

The updater module 16 is a mobile unit and is one of a plurality of similar units. Each unit includes a processor 30, a memory 32, an infrared transmitter/receiver 34, and an on-board battery 36.

The data display device 18 is one of a plurality of substantially similar units and includes a processor 40, a memory 42, a battery 44, an input/output infrared device 46, a clock 48, a motor 50 and a display 56.

Figure 2:
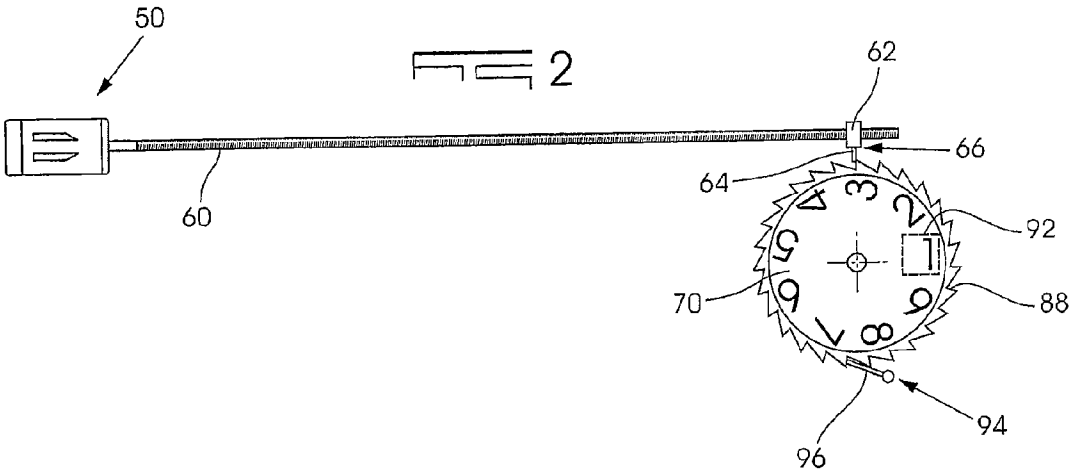
FIGS. 2 and 3 illustrate parts of an electromechanical display device used in the system of FIG. 1.

FIG. 2 shows the motor 50 which is a miniature DC motor with an output shaft which is connected to an elongate threaded rod 60. A nut 62 is threadedly engaged with the rod 60 and carries a ratchet lever 64 which is pivotal about a point 66. The lever can pivot about the point 66 in an anticlockwise direction but not in the reverse direction—this type of movement is restrained by means of a stopper (not shown).

The display 56 includes a plurality of substantially identical thin plastic or paper discs 70. Each disc is mounted to a support structure in a housing 74 and is rotatable about a central axis 76. The axes of the discs lie on a straight line 80 within the housing 74. Adjacent discs are displaced from each other in the direction of the line 80 by a distance 82.

Each disc has symbols, in this example the digits 0 to 9, positioned at regularly spaced intervals on the periphery of the disc. Each disc has a number of saw-tooth like formations 88 at regularly spaced intervals on its periphery.

A cover (not shown) overlies the disc. The cover is formed with a plurality of windows or viewing apertures 92 (shown in dotted outline only) and these are spaced so that only one digit on a respective disc can be viewed through a window.

The display device 18 has a ratchet mechanism 94 for each indicator 70. The ratchet mechanism includes a spring-loaded lever 96 which is positioned to interact with the formations 88 on the disc so that rotational movement of the indicator in a clockwise direction (referring to FIG. 2) is permitted, but rotation of the indicator in an anti-clockwise direction is not permitted.

Each display device, in the system, is mounted to a shelf or other fixed structure which accommodates particular goods or products with which the display device is associated. A primary function of the display device is to indicate in a manner (which is not dependent on the continuous supply of electrical energy) and which is adjustable, the price of the goods. This can either be on a per item basis or on a per pack or other basis. The principles of the invention are readily adapted to cater for different situations of this kind. Alternatively one or more display devices can be used with one device indicating an item price and a second device indicating a volume or mass price.

The central control unit 14 contains, in the memory 22, all relevant data pertaining to the products for sale in a particular store. A simplified typical record format for this data is shown in FIG. 1 and includes at least the following fields: an identity number 100 for a designated location on a shelf; an identifier 102 for products on the shelf; pricing information 104 of the products; the effective date of the pricing information (field 106); a display designator 108; and other data 110 which may vary according to requirement.

A substantial quantity of data, relating at least to statistical, administrative and sales information, in respect of each of the products, can be included in the memory 22. Depending on requirement all or part of this data can be included in the record format for each product in a manner which enables the data to be transferred to the memory of a relevant display device 18 at a shelf location, in the manner which is described hereinafter.

By way of example such further information can include the following:

- category (e.g. beverage/confectionary/hi-tech);
- VAT applicable or not;
- rate-of-sale (by day, week, month and year);
- stock levels (based on a common unit of measure by client and supplier e.g. cases/boxes/outers, etc);
- order dates;
- outstanding orders;
- cancelled orders;
- promotional periods;
- last update done and previous updates;
- cost and selling prices;
- row and shelf prices;
- off-shelf displays; and
- product history.

Information is transferred between the control unit 14 and the handheld updater module 16, as necessary. The data which is transferred typically includes a plurality of records of the kind referred to in connection with FIG. 1. Data transfer is effected by means of the infrared receiver/transmitter devices 24 and 34. Each record, as indicated, pertains to a shelf location and particular products on a given shelf. This information is held in the memory 32.

An operator carrying a module 16 which is updated with relevant pricing information, walks past the display devices 18 fixed to shelves in the shop. This enables the input/output device 46 to scan the transmitter/receiver 34. The memory 42 holds data similar to the record layout in FIG. 1 and this enables the identity of the particular location of the display device 18 to be compared to the identity field 100. The identity data 102 of the product in question is then compared to similar data in the memory 42. A purpose of this double verification is to ensure that the correct product on the correct shelf location is being addressed. When this validation has been achieved the pricing information contained in the field 104 is transferred to the device 18 and is stored in the memory 42. Similarly, information in the fields 106, 108 and 110 is transferred to the memory 42.

The transfer speed of data to and from a tag is high, in the order of 100 ms, and typically it is possible to update about ten display devices per second.

Once the data has been transferred to the display device a signal is returned from the device 18 to the handheld updater to indicate that the transfer has been effected successfully. The updater 18 is then returned to the control unit 14 and reconnected to the control unit. Information is transferred from the updater to the control unit to give an indication of the display devices which have been updated and any other information which may be relevant to the scanning operation.

In each display device the movement of the respective motor 50 is controlled via the processor 40 in response to the information held in the memory 42. The motor 50, when energized, causes rotational movement of the rod 60. The actuator nut 62 is threadedly engaged with the rod but is restrained from moving in a rotational sense. Thus rotation of the rod is translated into linear movement of the lever 64, either in a direction away from the motor or towards the motor, depending on the direction of rotation of the motor.

Figure 3:
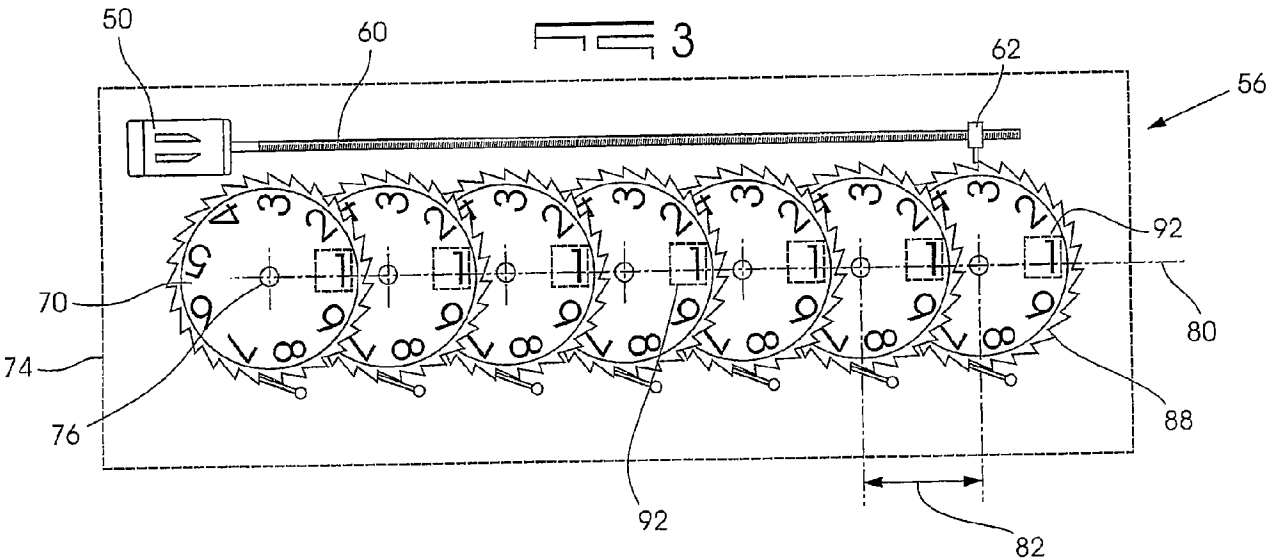

The lever 64 is thus linearly movable to and fro depending on the control protocol applied to the motor 50 and is usable to actuate each indicator directly. Referring to FIG. 3 if the lever is moved away from the motor it is caused to engage with one of the formations 88 on a respective indicator 70 and this causes the indicator to be rotated through a fixed angle in a clockwise direction. Once the lever has cleared the formation 88 the motor is reversed and the lever is then moved slightly towards the motor. This process can be continued, according to requirement, to cause a particular indicator to move through a desired angle. As the indicator moves, the numerical data held on the indicator is presented through a respective window 92. Once a desired symbol is visible through the window the lever is caused to operate on the next indicator, substantially in the same way, and the lever is operated to ensure that a desired symbol is exposed through the respective window.

The process is repeated for all of the indicators, as may be necessary, so that a desired price is shown through the windows 92. If seven discs are used it is possible to represent any price between zero and 99999,99. Clearly the number of indicator discs can be varied, according to requirement, to meet the particular pricing structure.

The processor 40 controls the movement of the motor 50 and in addition keeps track of the position of the linear actuator by means of an optically encoded disc, a linear potentiometer, or by using any other suitable tracking and control technique. The actual position of an indicator disc can be calculated by tracking the indicators which have been moved by means of the linear actuator.

The primary function of the system described is to transfer pricing information from the field 104 to the respective display device and then to ensure that the relevant discs are correctly aligned to ensure that a desired price is shown through the windows. If the pricing information is to take effect only on a particular day then it is possible to store the pricing information in the memory 42 together with data from the effective date field 106. The clock 48 keeps track of the actual time and date and when the actual date is reached which matches the effective date information, the processor 40 is enabled to ensure that the correct pricing information is transferred to the display 56. Similarly, if a particular product is to be the subject of a promotion, special offer or similar marketing technique then a light emitting diode or other attention grabbing device 120, on the display device, is activated, again on an effective date during a chosen time period. The diode 120 is then caused to flash for a defined period to attract attention to the display device 18 from passersby.

Each display device 18 is self-powered. If a battery 14 is depleted then the respective LED 120, which can be multicoloured, can be energised to indicate this to control personnel. However the price information remains displayed. Power is only consumed when the display 56 is required to change. The time required to make a price adjustment is not critical although typically this type of adjustment would be completed in less than 30 seconds.

Another benefit of the permanent type display system is that factors such as viewing angle and lighting conditions are not as critical as is the case with an active display system e.g. an LED-based system. A further advantage is that the size of the display, i.e. the numeric data, can be varied without incurring significant cost penalties. Colours and background detail are flexible and can be varied, within reason. Also, alphanumeric data, symbols and other information can be displayed as may be necessary.

The processor 40 is relatively small and is used to control the movement of the motor 50 and to keep track of the digits which are displayed. The clock 48 is a real time clock and, as stated, can activate scheduled price changes according to store promotions and so on.

The memory 42 acts as a repository for all information relevant to the product with which the device is associated. It is possible to extract data from the memory for statistical purposes. This can be done without interacting with the central control unit 14.

In the preceding example data is transferred between the central control unit 14 and each updater 16, using the infrared devices 24 and 34. This is non-limiting for communication can be achieved using any suitable interface e.g. by providing RS232, parallel or USB connectivity between each updater, and the control unit.

Figure 4:
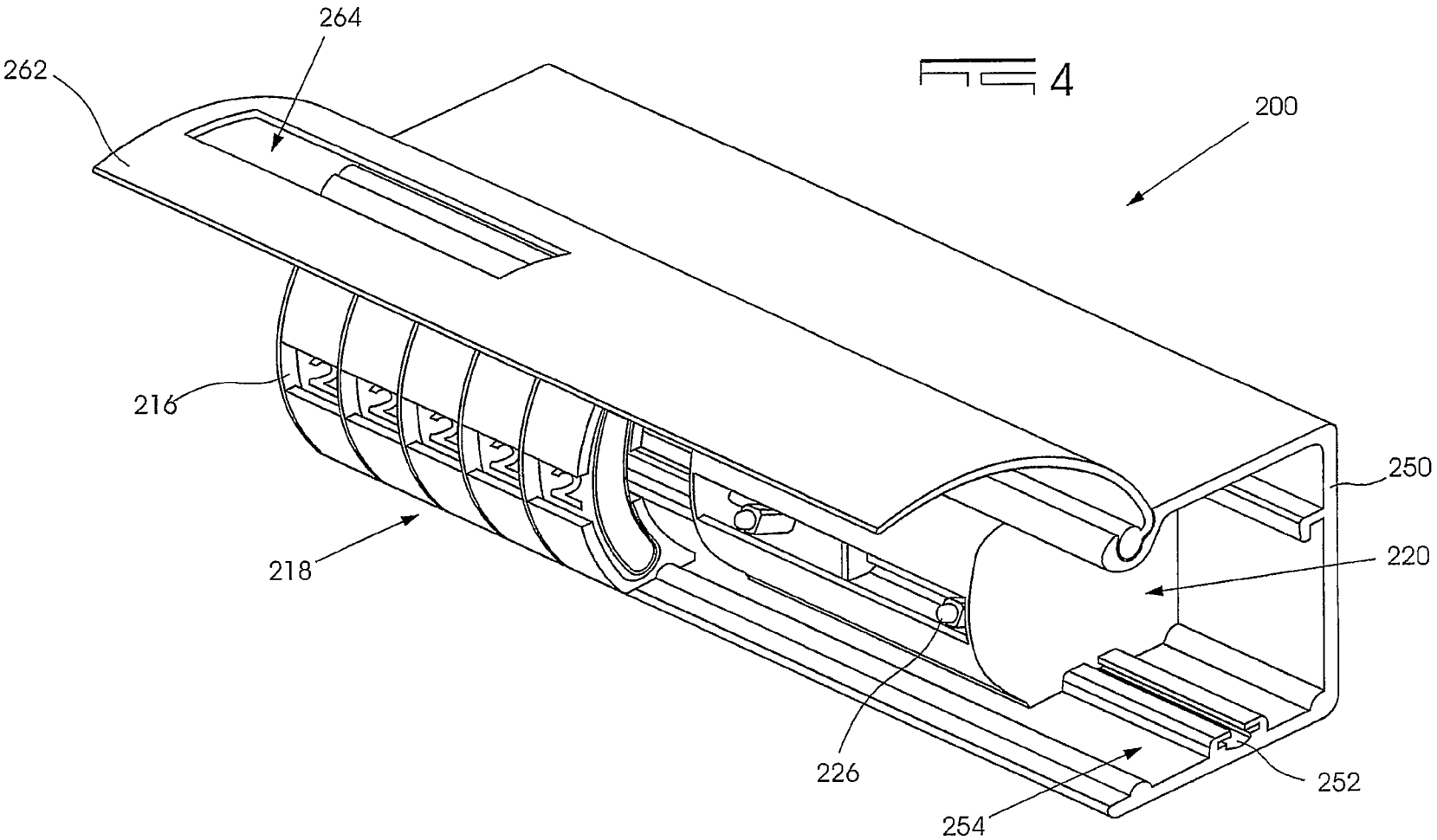
FIG. 4 shows a different display device.
Figure 5:
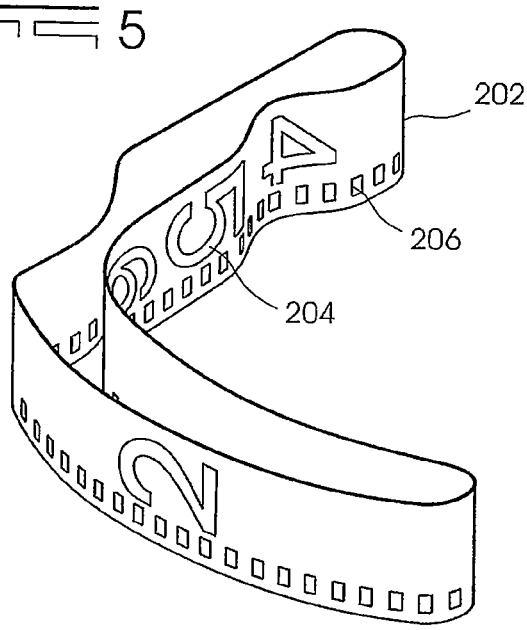
FIGS. 5 to 8 show components of the device in FIG. 4.

FIG. 4 shows a display device 200 according to a second form of the invention. FIGS. 5 to 8 illustrate components used in the display device. FIG. 5 shows an endless band 202 which is imprinted with desired alphanumeric characters or symbols 204 at regular intervals. The band has a number of sprocket holes 206 along a peripheral edge.

Figure 6:
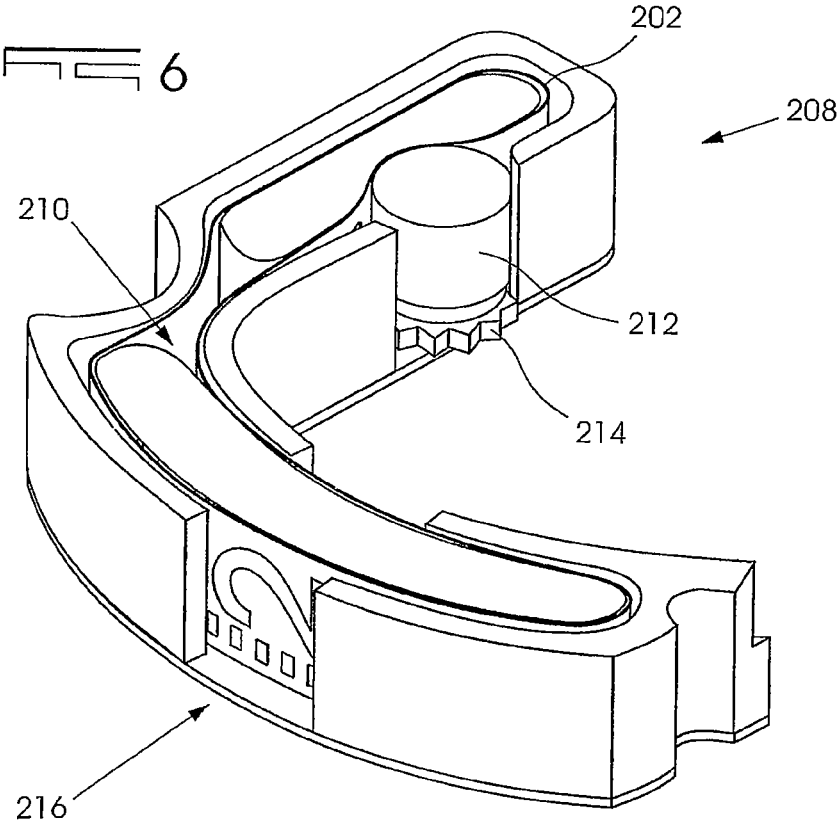

FIG. 6 shows a band carrier 208 which has a complex form designed to save space and to allow selected characters 204 to be viewed, when necessary. The carrier is moulded from a plastics material and includes a hollow core 210 in which the band is located. The band may pass around rollers, not shown, at opposed ends of the core. Mounted to the carrier is a roller 212 to which is fixed a small gear 214 which has teeth which engage with the sprocket holes 206. A window 216 is positioned on one side of the carrier so that symbols or characters on the band can be individually viewed through the window.

Figure 7:
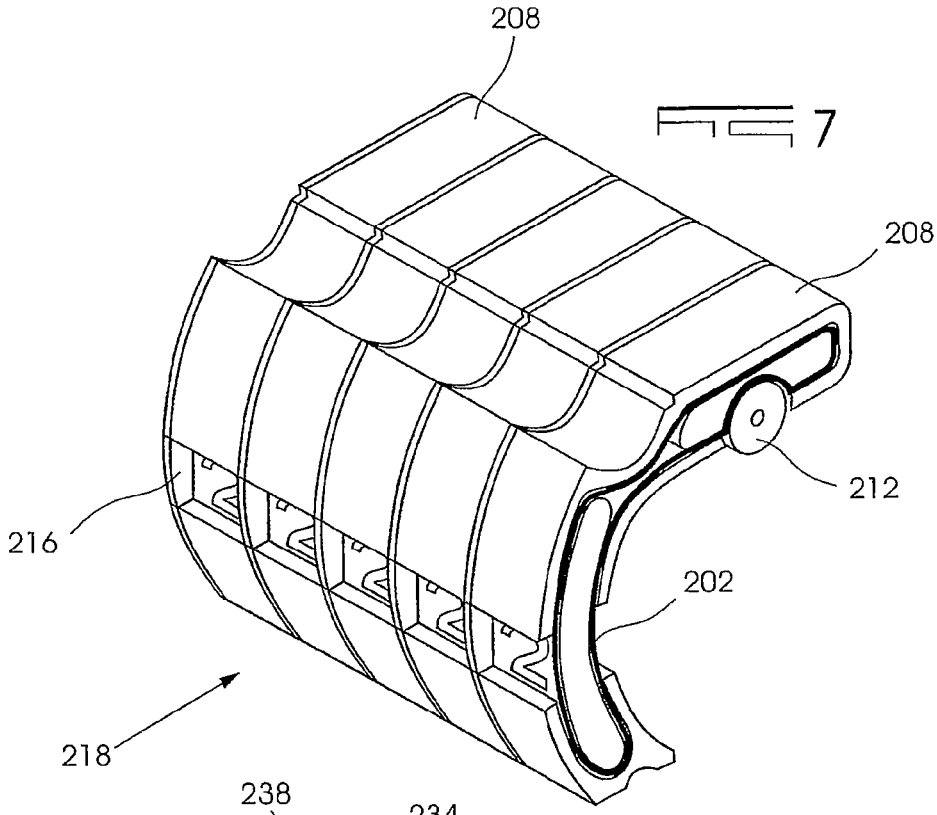

FIG. 7 shows a number of the carriers 208 assembled side by side to make up a display assembly 218. The respective windows 216 are horizontally aligned and the respective gears 214, which are on an inner side of the assembly, are also aligned.

Figure 8:
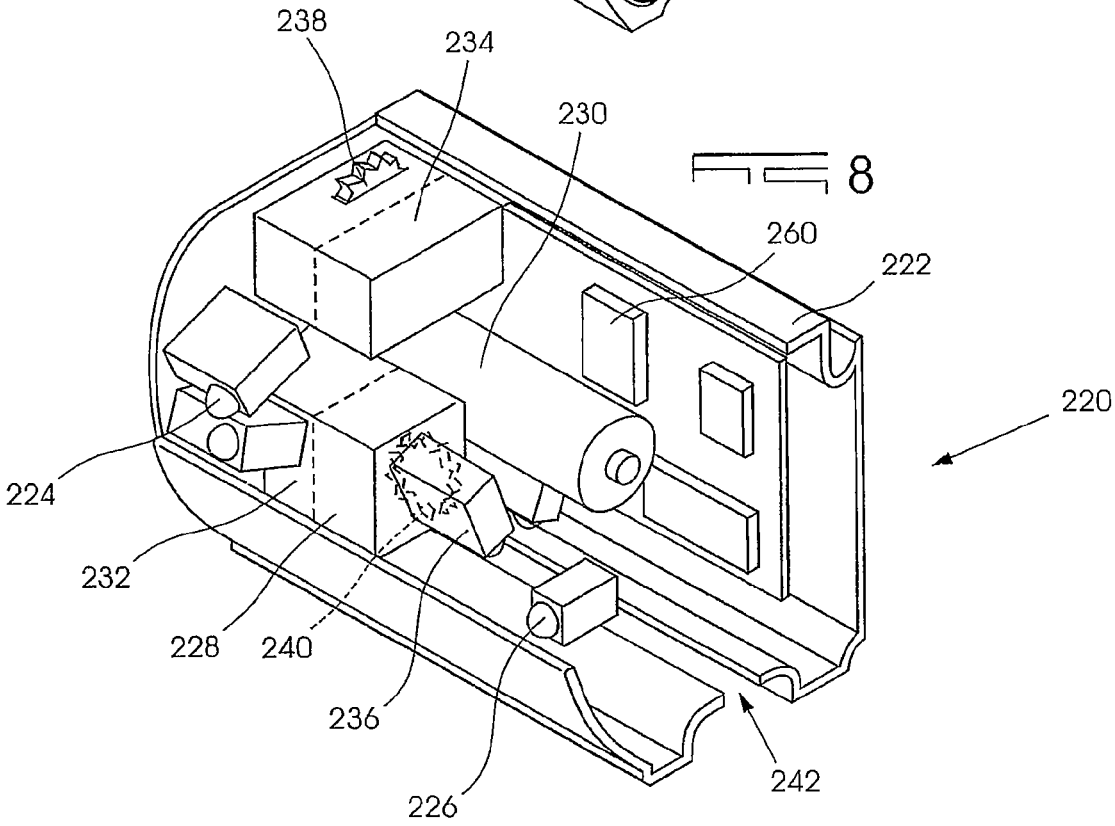

FIG. 8 shows an actuator 220 which is used for causing movement of the bands within the respective carriers. The actuator includes a small housing 222, sensors 224 and 226, a battery 228 and two small motors 230 and 232 respectively. Each motor works through a corresponding small gear box 234 and 236 and drives a respective output cog 238 and 240. The cog 240 is shown notionally only, for it is obscured by the gearbox 236. The cog 240 faces downwardly through a gap 242 in the housing.

FIG. 4 shows the actuator 220 inside a linear casing 250 which has a track 252 on an inner surface 254. The cog 240 is engaged with teeth formations (not shown) in the track. Operation of the motor 232 in one direction or the other causes corresponding rotational movement of the cog 240 and the actuator can thus be moved to and fro within the casing 250 in a controlled manner which is determined, at least, by input signals from the sensor 226, transmitted to a controller 260 in the actuator.

The display assembly 218 is mounted to the casing. A cover 262 is fixed to the casing and can be lowered to conceal the actuator. The respective windows 216 of the carriers are visible through a transparent portion 264 of the cover.

Figure 9:
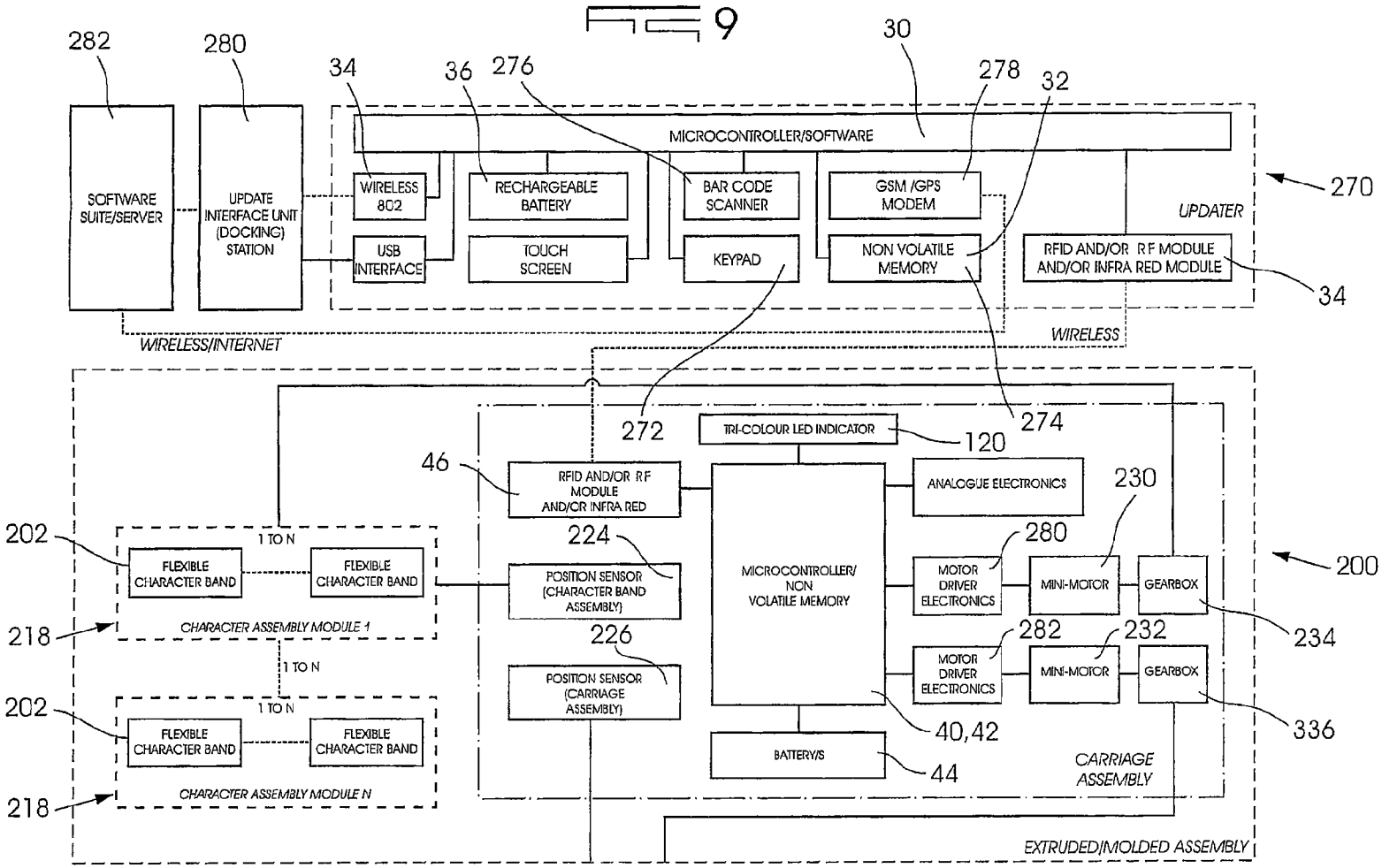
FIG. 9 is a block diagram of a system which is based on the use of a plurality of the devices in FIG. 4.

FIG. 9 is a block diagram representation of the electromechanical display device 200 and an updater module 270 which, in many respects, is similar to the updater 16 shown in FIG. 1. More detail is however shown in FIG. 9 although, where applicable, like reference numerals are used to designate like components. The updater can for example include a display screen 272, an input mechanism in the form of a keypad 274, a barcode or similar scanner 276 and a GSM or GPS modem 278 which can be adapted for use to ensure that the updater is only employed in a designated location. Attempted use of the updater outside of a designated geographical location can be blocked by software in the processor 30 which is responsive to positional data from the modem.

The display device 200 also has substantial similarities to the device 18 shown in FIG. 1 but, again, more detail is given. The display device 200 includes two motors 230 and 232 which drive the respective gear boxes 234 and 236. Each motor is under the control of driver electronics 280 and 282 which, in turn, are controlled by a microprocessor 40. The sensor 226, as noted, enables the position of the actuator on the track 252 to be monitored. The sensor 224 is used to monitor the position of a band 202 when the actuator is docked with the corresponding carrier 208.

From an inspection of FIGS. 4 and 7 it is clear that information carried on the respective bands can be viewed through the window. A display of this information does not require an ongoing supply of electrical energy. Energy is however required to alter the position of each band within its carrier. To do this information is sent from the updater 270 and decoded in the processor 40. The processor keeps a record of the position of the actuator relatively to a given display assembly 218. The bands which are to be moved are identified and the microprocessor causes the motor 232 to rotate in the appropriate direction, along the track 252 so that the actuator is moved to bring the gear which protrudes from the gearbox 232 into meshing relationship with a gear 214 on a designated band carrier. The position of that band is known from data which is stored in the memory 42. The motor 30 is then driven in the appropriate direction to move the band so that the required symbol is displayed through the window 216. In most instances only small movements are required. For example if a price of an item is increased from 9.50 to 9.60 then one band only will be moved through one position.

At all times data on the positions of the bands is kept in the memory 42—this corresponds to the pricing information which must be displayed.

In a manner which is similar to what has been described hereinbefore successful data transfers from the updater to price display 200 are validated and information is transferred to the updater 270. In subsequent steps information from the updater can be uploaded via an interface or docking station 280 to a centralised server 282.

The arrangement which has been described minimises the electronic and electromechanical component count by using a single carriage (actuator) to control any number of the assemblies 218. The system is modular and this allows for larger character assemblies without having to redesign the software which is used to control the electronics and the electromechanical components. Each band 202 may be continuous but it is also possible for the band to be non-continuous so that the band can rotate and spool onto two rollers as necessary. An advantage of this approach is that a longer band containing more characters can be fabricated.

Figure 10:
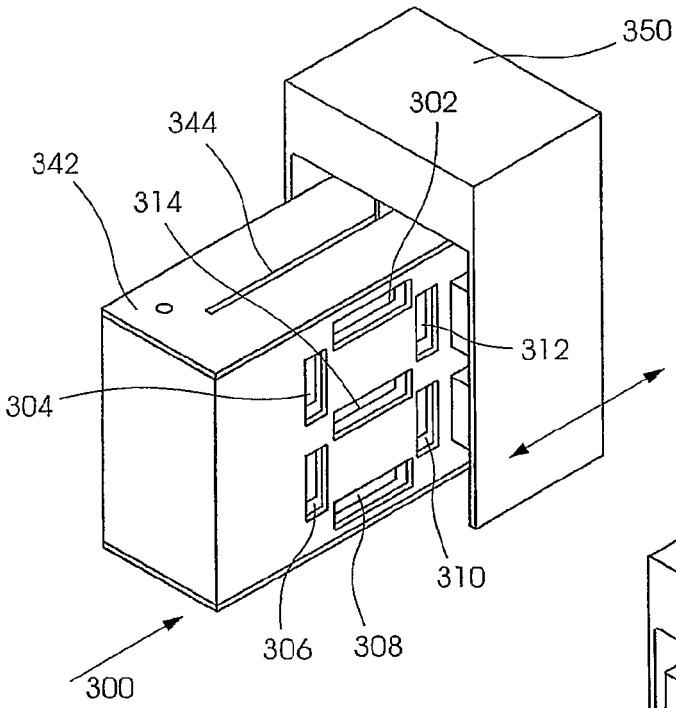
FIG. 10 shows another display device.
Figure 11:
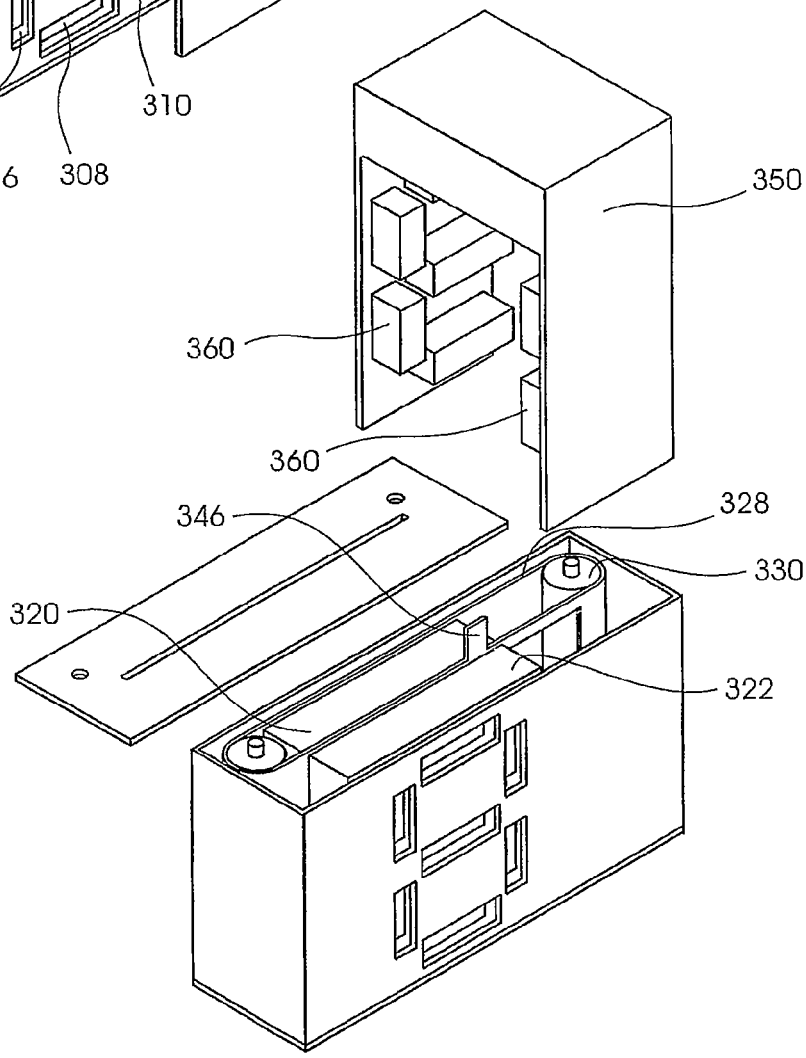
FIGS. 11 to 13 show components of the device in FIG. 10.
Figure 13:
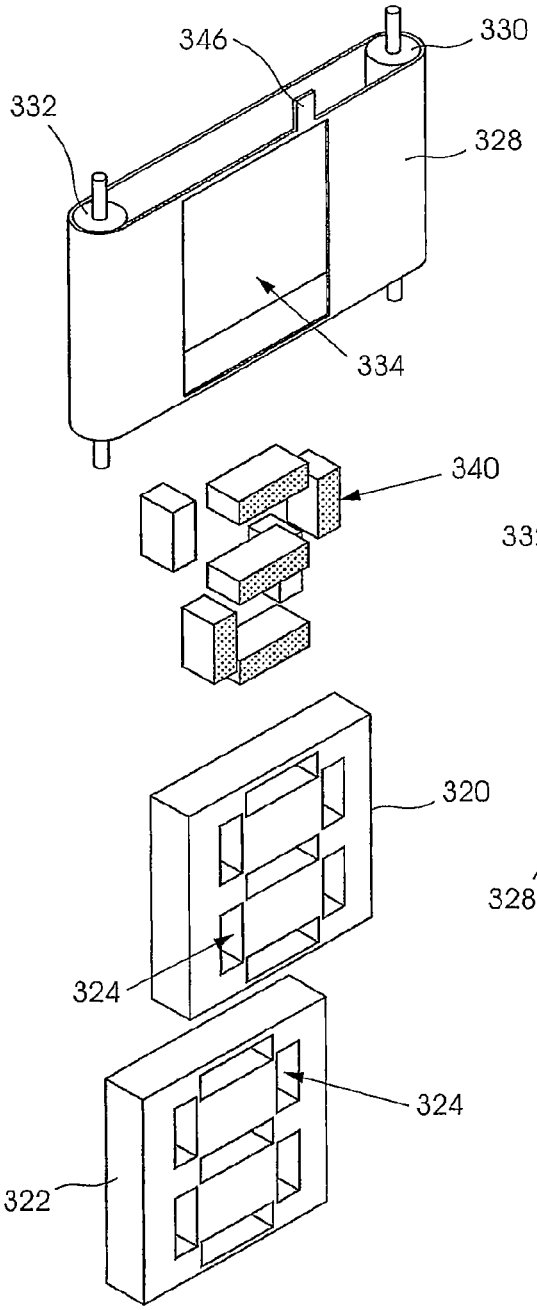
Figure 12:
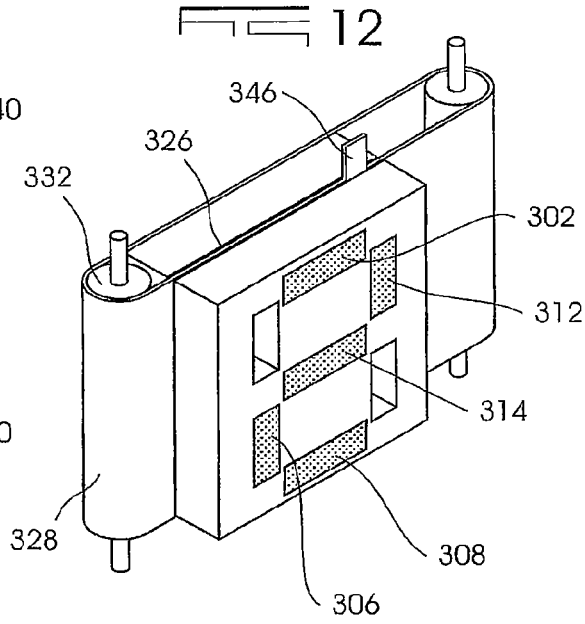

FIG. 10 shows a display device 300 which is in the form of a seven-segment display. FIGS. 11 and 13 show various aspects of the device 300. The seven segments are designated 302, 304, 306, 308, 310, 312 and 314 respectively. In this example each display includes seven indicators which are manipulated by means of an actuating system to make up a desired symbol which can be represented by choosing any of the segments 302 to 314.

The display has two small blocks 320 and 322 respectively which are identical. Each block is formed with seven passages 324 which, viewed end on, are in the form of a conventional seven-segment display format. The blocks are positioned side by side with a small gap 326 between them. An endless roll 328 is passed around two spaced rollers 330 and 332. One length of the roll is positioned in the gap. A large window 334 is formed in the roll. Small block-shaped members 340 which are made of a suitable electromagnetic material such as steel are positioned in the passages 324 of one of the blocks. As will become evident from the ensuing description each member could be replaced by an electromagnetic dust or similar material. A cover 342 overlies the two blocks and has a small slit 344 which is in register with an upper edge of the gap 326. A small protrusion 346 which is fixed to an edge of the roll 328 extends through the slit 344.

An actuator 350 is positioned to one side of the two blocks 320 and 322. The actuator has, fixed to it, a motor which is similar to the motor 232 and which, via a gearbox, can cause linear movement of the actuator to and fro along a track, not shown, which is similar to the track 252 shown in FIG. 4. Thus the actuator can be moved precisely so that it is positioned over the exposed passages 324 in the blocks, according to requirement.

The actuator also carries seven sets of electromagnetic coils 360, one for each passage. In one respect these coils replace the motor 230 shown in FIG. 9. The actuator is in other respects similar to what is shown in FIG. 9 but the position sensor 224 is not required.

When data is transferred from the updater 270 to the actuator the actuator is caused to move so that it is positioned over the blocks 320 and 322. When this occurs the actuator strikes the protrusion 346 and the roll 328 is moved so that the window 334 which is between the blocks then overlies the exposed passages which make up the seven-segment format. The electromagnetic coils 360 are then selectively energised. Each set of coils can be energised in a positive or negative sense. If a coil is energised positively then the member 340 in the passage which is overlain by the coil set is attracted to the block 322. If the coil set is energised negatively then the corresponding member 340 is electromagnetically urged in the opposing direction i.e. into the corresponding passage in the block 320.

Assume for example that the number 2 is to be formed. Members in the passages which correspond to the segment portions 302, 312, 314, 306 and 308 are brought into the block 232 and the remaining members are kept in the block 320. The actuator 350 is then moved in the reverse direction. When this happens the actuator, working via the protrusion 346, causes the roll 328 to counter-rotate and the window is moved away from the interfaces between the passages in the two blocks. A solid portion of the roll is then located in the gap 326. The roll is made from a material which is of a contrasting colour to the colour of the members 340. Thus, in the given example, the members 340 which make up the numeral 2 are clearly visible while portions of the roll, of a different and contrasting colour, effectively close off the remaining segment portions and help to clarify the view of the desired character.

Three examples of the display system have been described. In each instance use is made of an actuator which is electrically powered and which is precisely controlled to move to predetermined positions and, at each position, according to requirement, the actuator is operated to cause corresponding movement of an indicator. As noted the indicators may carry symbols and in this instance the indicators are moved so that desired symbols are displayed through one or more viewing windows. In another form of the invention the indicators themselves are moved to make up a desired symbol, as is the case with the arrangement shown in FIGS. 10 to 13.

An overriding benefit of the invention is that, in each embodiment, the actuator is electrically driven but the display devices are mechanical in nature and do not require an ongoing electrical supply to provide a permanent display. It is possible therefore to make up a comprehensive display system at a low cost per display tag or label.

In the embodiment of the invention shown in FIGS. 2 and 3 an actuator (electric motor) is associated with a particular display device. When use is made of a track based system, as is the case with the embodiment shown in FIG. 4, it is apparent that the actuator 220, which travels along the track, is used to actuate any of the carriers in a display assembly. This principle can be further extended in that a single actuator can be used to actuate each of a plurality of display assemblies which are mounted to a common track. A similar observation applies in respect of the display arrangement shown in FIGS. 10 to 13. The actuator 350 would be moved along a single track past a large number of display devices. All that is necessary if for the actuator to "know" where it is and then to cause movement of the display segments. This type of application is readily accomplished using suitable control techniques for, conceptually, there is little difference between using an actuator to manipulate symbols in a single display assembly or using the actuator to manipulate symbols in a display assembly chosen from a plurality of assemblies.

Figure 14:
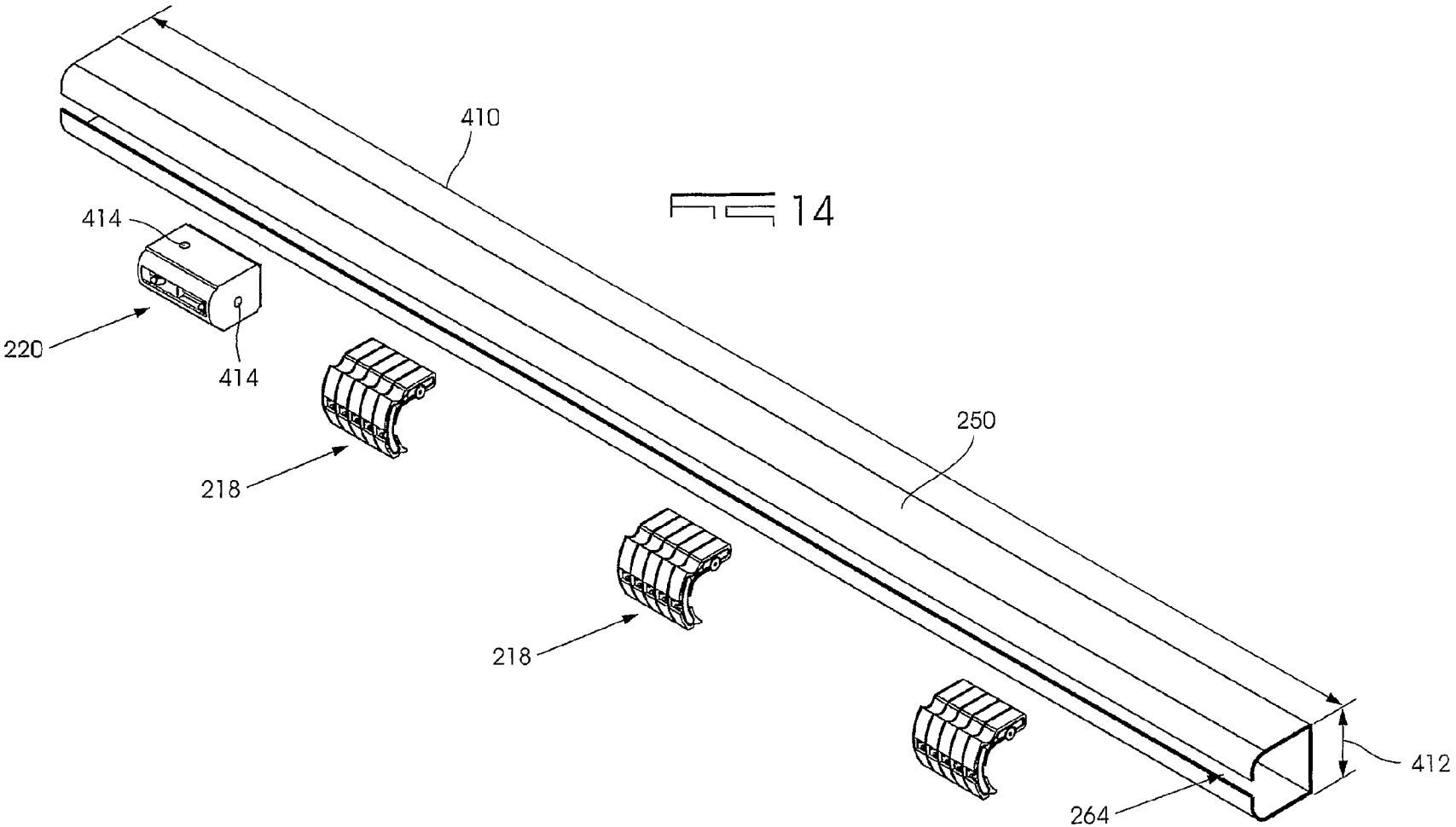
FIGS. 14 and 15 depict further features of the invention.

FIG. 14 is a somewhat schematic representation showing how a single actuator 220 which is mounted to an elongate track 250 is used to control the operation of each of a plurality of display assemblies 218. Each display assembly is of the kind described hereinbefore and is mounted to the track at an appropriate location e.g. adjacent goods to which the information carried by the display assembly relates. Gaps between adjacent display assemblies can be masked off or carry advertising according to requirement. It is conceivable that gaps between adjacent display assemblies could be filled with modified display assemblies which, for example, instead of carrying pricing information could carry descriptive information relating to the goods to which the pricing information relates. The actuator 220 is moved along a track, not shown, inside an elongate linear casing 250 which is extruded from a suitable metal or plastics material. The sensors on the actuator enable the control electronics to identify, exactly, the position of the actuator and, as the actuator is docked with each display assembly bands inside the display assembly are manipulated as required to update the pricing information.

The same technique can be adopted, using the components shown in FIGS. 10 to 13, to allow for a single actuator to be used with a plurality of segmented displays.

An advantage of the approach shown in FIG. 14 is that the actuator 220, which contains active electronic components, is used with the passive mechanical display assemblies in a cost effective manner which reduces the overall cost per display assembly.

Figure 15:
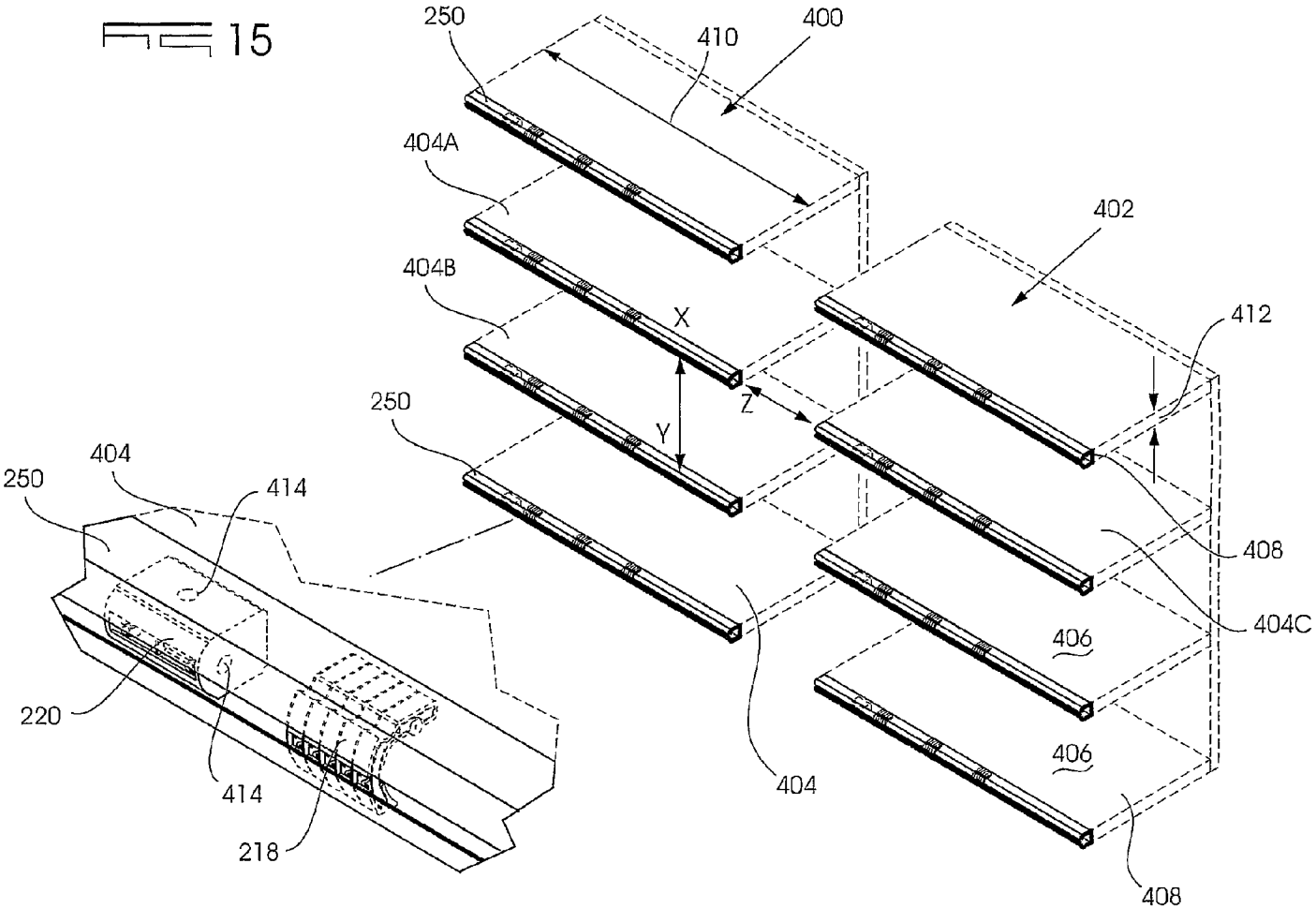

FIG. 15 illustrates a further extension of the principles of the invention. FIG. 15 shows two display racks 400 and 402 respectively which are positioned side by side. Each rack has a number of shelves 404. Only two racks are illustrated but this is for exemplary purposes only and is non-limiting. The number of racks can be extended linearly, within reason, according to requirement. The shelves on one rack are horizontally aligned with the shelves on an adjacent rack. Each shelf has a planar upper surface 406 and a front edge 408 and carries an elongate housing 250 of the kind shown in FIG. 14 which is fixed to the front edge. The housing has a length 410 and width 412 which are substantially the same as for the front edge and this fits neatly and unobtrusively on the front edge. A plurality of display assemblies are fixed to the housing, in the manner which has been described. The display assemblies are not shown in FIG. 15.

The actuator 220 has a number of transmit/receive infrared diodes 414 at strategic locations. Assume that an actuator on a shelf 404A is at a position X which is directly above a position Y on an adjacent shelf 404B which is occupied by a second actuator. A diode 406 on one actuator is thereby brought directly into a vertical line-of-sight relationship with a corresponding diode on the other actuator. It is then possible for two-way communication to take place between the actuators on the shelves 404A and 404B and data can therefore be transferred between these actuators. A similar situation arises (in the example) when an actuator on the shelf 404A moves to a position Z at one end of the shelf which directly opposes a position W at an end of a shelf 404C. Respective diodes on the two actuators are thereby brought into horizontal line-of-sight register with each other and communication, and hence data transfer, can take place between the two actuators. In practical terms what this means is that it is possible for an operator using an updater to update all of the information in an aisle simple by updating the first or closest actuator which then acts as a master. The master in turn daisy-chains and talks via each successive actuator, which functions as a slave, and information flows down the shelves on one side of the aisle in a horizontal direction and, within each display rack, in a vertical direction.

Infrared communication between adjacent actuators is readily achieved but this, nonetheless, is exemplary only for other near-field communication systems such as radio frequency, ultrasonic devices, ID tags and the like can be used. It therefore becomes possible to establish a two-way communication link between physically close display devices which are correctly orientated with respect to each other.

A significant benefit which flows from the aforementioned process is that, when the display devices are to be updated, an operator would be required to walk along a main aisle only and, in the process, communicate with each master display device at an end of a feeder aisle leading off the main aisle. The master then communicates, in the manner described, in daisy-chain fashion with each of the display devices in the feeder aisle.

The updater 270, in this application, is effectively unchanged from what is shown in FIG. 9. Data is transferred to the master display device via the module 46. This module thereafter, in a transmit mode, transfers data to a module 46 in a subsequent display device. The process continues in this way down the chain of display devices. Clearly the data which is intended for a particular display device must be uniquely linked to that display device. This is readily achieved by means of a code which is stored beforehand in the memory of the display device. This ensures that the updating data is correctly used to manipulate the respective indicators in the display devices.

The preceding description refers primarily to the ability to update pricing information relating to a plurality of goods, for example in a store. The pricing information is made visible to customers.

Figure 16:
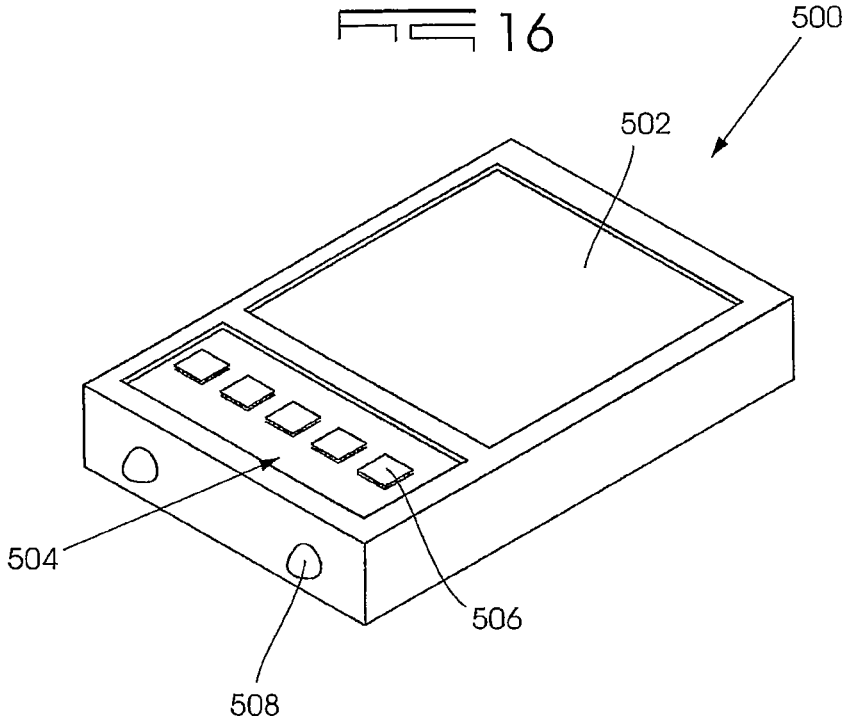
FIG. 16 shows a possible customer device.

It is possible however to make use of aspects of the invention to enable a customer to interact with a data display system which is based on the aforementioned principles. FIG. 16 illustrates a portable device or apparatus 500 which is intended to be used by a customer, not shown, in an interactive manner with the system of the invention. The apparatus 500 includes a user interface screen 502 which can be touch sensitive, and an interface keypad 504 with navigation buttons or keys 506. These could be arrow keys, alphanumeric keys or the like.

The device includes one or more infrared diodes 508 for communication purposes.

Assume that a customer, equipped with the device 500, requires further information regarding a particular product which is associated with one of the display devices which have been described hereinbefore. The associated actuator includes a memory. Detailed information, apart from pricing information, relating to each particular product, the price of which can be altered by the actuator, is stored in the memory of that actuator. A customer is then able to interrogate the memory by pointing the apparatus 500 at the actuator so that a communication link is established via the infrared diodes with the actuator. This is a two-way communication link.

If the product in question is a food item then the memory could hold nutritional information relating to the food item and this could be transferred to the device 500 and displayed on the screen 502. Other information which could be stored and then extracted by a customer, upon request, could extend to carbon footprints, an audit trail of production origination and manufacturing conditions and so on. In fact any information which, primarily due to size constraints, could not be included on a label, could be stored in the memory and extracted by a customer when required.

If the device 500 is uniquely associated with a customer, either because the device belongs to a customer or because a customer enters a pin code or other identifier into the device then it is possible for a store to keep track of a customer's requirements and buying habits. A customer could for example purchase a particular item and data on the purchase and the identity of the customer could be recorded. This information would initially be stored in a memory associated with the display device and later transferred to one of the updaters for record-keeping and management services.

Thus, in general terms, the use of a memory, at a particular location, to store data relating to a number of items which are physically close to the location lends itself to an interactive system in which a customer can extract data from the memory and, in the reverse direction, information on the customer and shopping preferences etcetera can be transferred to the memory for subsequent use by store management.

The invention claimed is:

1. A display device which includes a housing, a plurality of separately movable indicators in the housing, an electrically operable actuator movable relative to the housing to any one of the plurality of indicators, and a controller for controlling operation of the actuator, the actuator being configured to be moved relative to the housing to a selected one of the plurality of indicators whereby the selected indicator is then independently movable by the actuator to a selected position.

2. A display device according to claim 1 wherein the housing has at least one window and the indicators are mounted so that at least portions of the indicators are visible through the window.

3. A display device according to claim 1 wherein each indicator includes a plurality of symbols.

4. A display device according to claim 1 wherein a plurality of the indicators are manipulated to represent a chosen symbol.

5. A display device according to claim 1 wherein each indicator is movable along a defined path, in a controlled way, to present a chosen symbol for viewing, through a window.

6. A display device according to claim 1 wherein indicators selected from a designated plurality of indicators are moved to make up a chosen symbol and indicators which are not selected are blocked from view.

7. A display device according to claim 1 wherein each indicator includes a plurality of formations for direct or indirect engagement with the actuator.

8. A display device according to claim 1, wherein the actuator is adapted to move in a linear direction along a longitudinal axis to cause rotation of each of the indicators about a respective axis of rotation.

9. A display device according to claim 8, wherein the axis of rotation of each of the indicators is perpendicular to the longitudinal axis.

10. A display device according to claim 1, wherein each of the indicators is movable by rotation and permitted to rotate in a clockwise direction and restricted from rotation in a counterclockwise direction.

11. A display device which includes an electrically powered actuator, a housing, a window in the housing, an indicator which is mounted to the housing for movement relative to the housing and a receiver, which in response to an externally transmitted signal, causes linear movement of the actuator to a predetermined position and the linearly moved actuator, in response to the signal, causes rotary movement of the indicator so that at least part of the indicator is visible, through the window.

12. A data display system which includes a data store, apparatus to transfer data from the data store to a display location which is selected from a plurality of display locations and, at each display location, a respective actuating mechanism configured to be moved to any one of a plurality of indicators of the display location and which, in response to data transferred to the respective display location, moves to a selected one of the plurality of indicators of the display location and causes movement of the selected indicator to display information from the store.

13. A data display system according to claim 12 which includes a portable apparatus for transferring data to, and for extracting data from, the data store.

14. A data display system according to claim 12, wherein the actuating mechanism is adapted to move in a linear direction along a longitudinal axis to cause rotational movement of the selected indicator about at least one axis of rotation.

15. A data display system according to claim 14, wherein the at least one axis of rotation is perpendicular to the longitudinal axis.

16. A display arrangement which includes an elongate housing, a plurality of display assemblies which are positioned at spaced locations along the housing with each display assembly including a plurality of separately movable indicators, an electrically operable actuator which is movable along the housing to a selected display assembly and to any one of the plurality of separately movable indicators of the selected display assembly, and a controller for controlling operation of the actuator whereby each indicator of the selected display assembly is independently movable by the actuator to a selected position.

17. A display installation which includes at least two display arrangements, each display arrangement being according to claim 16, wherein the elongate housings are positioned horizontally in line or vertically spaced apart so that actuators of the display arrangements are movable to registering positions for data transfer from one actuator to the other.

18. A shelf for a display rack which includes a body with a planar upper surface and a front side, and a display arrangement according to claim 16, wherein the elongate housing is fixed to the front side and is of substantially the same length and height as the front edge.

19. A display arrangement according to claim 16, wherein the actuator is movable in a linear direction along a longitudinal axis of the housing to cause rotational movement of each of the indicators about a respective axis of rotation.

20. A display arrangement according to claim 19, wherein the axis of rotation of each of the indicators is perpendicular to the longitudinal axis.

* * * * *